US005263614A

United States Patent [19]

Jacobsen et al.

[11] Patent Number: 5,263,614

[45] Date of Patent: Nov. 23, 1993

[54] MATERIAL DISPENSING TOOL FOR TUBULAR CARTRIDGES

[76] Inventors: Kenneth H. Jacobsen, 921 N. Quentin Rd., Palatine, Ill. 60067; Louis F. Cole, 374 E. Hiawatha Trail, Wood Dale, Ill. 60191

[21] Appl. No.: 882,836

[22] Filed: May 14, 1992

[51] Int. Cl.[5] ..... B67D 5/52

[52] U.S. Cl. ..... 222/137; 222/145; 222/327; 222/386; 222/391

[58] Field of Search ..... 222/135, 136, 137, 145, 222/153, 326, 327, 386, 390, 391

[56] References Cited

U.S. PATENT DOCUMENTS

| | | | |
|---|---|---|---|
| 2,786,604 | 3/1957 | Collins | 222/327 X |
| 3,311,265 | 3/1967 | Creighton, Jr. et al. | 222/327 X |
| 4,509,662 | 4/1985 | Weiss | 222/391 |
| 4,869,400 | 9/1989 | Jacobs | 222/391 X |
| 5,054,655 | 10/1991 | Keller | 222/153 |
| 5,104,005 | 4/1992 | Schneider, Jr. et al. | 222/390 X |
| 5,161,715 | 10/1992 | Giannuzzi | 222/135 X |

*Primary Examiner*—Andres Kashnikow

*Assistant Examiner*—J. A. Kaufman

*Attorney, Agent, or Firm*—Charles F. Lind

[57] ABSTRACT

The improved dispensing tool has linkage that includes a spring connected between a power ratchet and a wall restraining the material cartridge against plunger movement through the cartridge for discharging material, thereby allowing resilent independent plunger movement within the limits of spaced stops. When subjected to only static force conditions, the spring bottoms the linkage solid against one of the stops, to provide in-unison forward indexing of the plunger and ratchet drive rod. In the event plunger displacement occurs that is less than the expected in-unison indexing, the one linkage stop is gapped to subject the spring to additional dynamic force conditions that biases the plunger resiliently and continuously in the forward direction toward the restraining wall, up to maximum dynamic force conditions that bottoms the linkage solid against the other stop. The dynamic spring forces move the plunger forwardly within the cartridge for discharging the contained material.

21 Claims, 5 Drawing Sheets

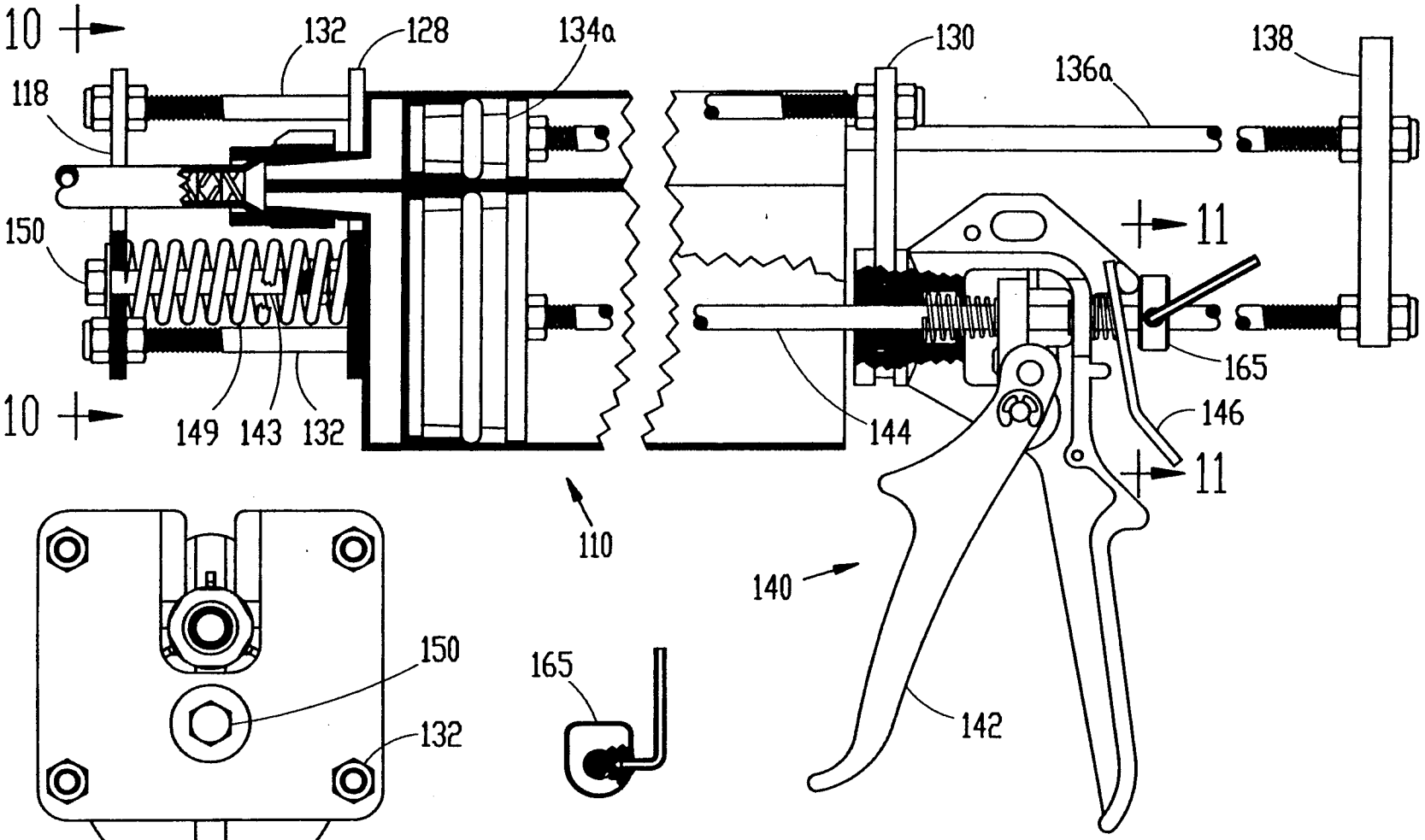
Fig. 9
Fig. 11
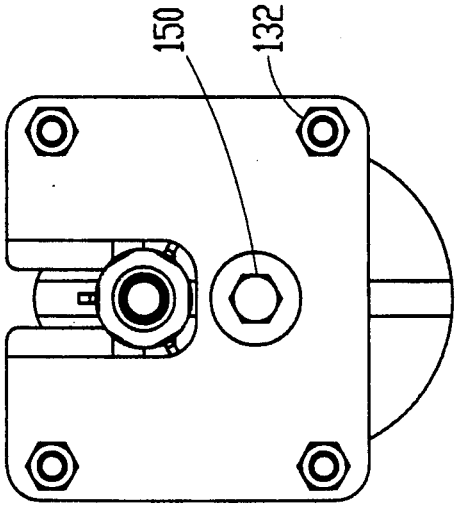
Fig. 10

MATERIAL DISPENSING TOOL FOR TUBULAR CARTRIDGES

BACKGROUND OF THE INVENTION

Caulk, adhesive, potting material and other fluids are commonly contained in cartridges of the type having a tubular side wall and a closure wall and nozzle at one end and an opposite open end that is closed by a wiper slidably seated against the inside face of the side wall. Dispensing tools are available to hold these cartridges, and to move a plunger axially of and into the open cartridge end and against the wiper, for discharging the contained material from the open nozzle. Available dispensing tools can be powered pneumatically or manually. Although pneumatic tools generally outperform manual tools, manual tools are yet in demand because of advantages including costs and portability compared to pneumatic tools.

Most manual dispensing tools utilize a rod connected to the plunger and a power device, such as a ratchet mechanism activated by squeezing a trigger, that incrementally indexes the rod and its connected plunger axially of the cartrigde and toward the nozzle. A user's needed strength and experienced fatigue, and poor continuity of material flow, are major shortcomings of using the broadly described manual dispensing tools.

For example, most contained materials are substantially incompressible liquids or pastes having poor flow characteristics and/or high viscosities, and frequently the material must be discharged against a significant back pressure. Thus, large axial forces must be exerted on the plunger rod to advance the plunger through the cartridge. It is possible to use different ratio ratchet mechanisms to generate greater indexing forces, but as the indexed distance and generated force will be inversely related, a major drawback against user acceptance may be the additional number of squeezes needed to provide the intended volume of material discharge.

Moreover, with substantially incompressible liquids or pastes, the plunger advance must correspond exactly to the needed rate of material discharge. Each squeezing stroke ideally would take place over a short duration, within a second or so. However, such rapid completion of a squeezing stroke would typically advance the plunger significantly more than needed to provide the intended material discharge rate. Consequently, it has been necessary with an indexing power device, to extend each squeezing stroke over a longer continuous duration, in order to obtain the intended material discharge rate. When large squeezing pressures are also needed approaching even the user's maximum strength, cramped muscles are commonplace when the user must maintain such squeezing pressures continuously, squeeze after squeeze.

The above factors contribute to poor continuity of material flow, where rest pauses in the manual powering effort would typically result in a pulsed material discharge. However, even though a user conscientiously tries to produce a uniform material discharge against a high back pressure, during that brief pause between each trigger squeeze, the material discharge will virtual stop to yield a pulsed discharge.

These shortcomings are intensified when the dispensing tool and/or intended discharge point must be inconveniently located relative to the user, such as when making upwardly directed material discharges or when reaching excessively.

Moreover, materials having very desirable physical properties frequently can be formed by blending together several specific components according to precise proportions. Existing manual dispensing tools for such multiple component material systems utilize a separate cartridge for each different component, and force all component discharges through a single mixing nozzle for yielding a single combined material discharge. The separate cartridges are held in adjacent side-by-side relationship, and separate plungers are advanced in unison through the respective cartridges. As the components and their ratios can be varied to yield different materials, component cartridges are available in different sizes and diameters.

Proper mixing of the multiple components requires significantly higher static discharge heads, compared to that required with a single component material, and thus magnifies the mentioned shortcomings of existing ratchet activated dispensing tools. Moreover, the inventors have found that such dispensing tools are marginally effective when dispensing multiple component materials, as the pulsed discharges disrupt proper component mixing and/or proportioning. Instead, the material discharges are inconsistent, even during the same run or during different runs using the identical component cartridges, and exhibit different, unexpected and inferior physical properties.

Common examples of multiple component materials would include two-part epoxies, urethanes, silicones, phenolics, acrylics and polyesters.

Common material discharge rates can be small, to provide better discharge penetration into cracks and/or control in laying down a material bead and/or to generate a higher static discharge head for increased mixing of multiple component materials.

Filling surface cracks in concrete structures serve as but one example of a multiple component material being successfully used, being admitted as a flowable liquid or paste that then bonds to the faces of the crack and hardens, to reinforce the concrete and restore its structural integrity.

SUMMARY OF THE INVENTION

This invention relates to tools for dispensing flowable materials from tubular cartridges, particularly to such tools that have plungers and manually activated power devices and drive linkages that force each plunger relative to and within its cartridge for causing material discharge from the cartridge via a nozzle or the like.

A basic object of this invention is to provide a manual dispensing tool suited to provide and maintain continuous and more uniform dispensing pressures on the contained material for improving the continuity of material discharge from the cartridge.

A more detailed object of this invention is to provide in the drive linkage a spring means suited to be strained for automatically storing any part of the energy inputted to the power device upon its activation that cannot be used immediately, to allow then later dissipation of the stored energy for maintaining continuous dispensing pressures on the contained material and nonpulsed material discharge from the cartridge.

A related object of this invention is to provide in the drive linkage having the spring means a lock means suited to preclude plunger movement within the cartridge, thereby allowing all inputted energy of activation to the power device to be stored by straining the spring means, and upon the subsequent release of the lock means allowing material discharge from the cartridge.

Another object of this invention is to provide in the drive linkage a lock means suited to measure plunger movement within the cartridge, even in the event of continued attempted activation of the power device, for metering material discharge from the cartridge.

Yet another object of this invention is to provide a tool having a manually indexed power device and drive linkage simultaneously powering mechanically interconnected plungers that respectively cooperate within separate cartridges of a multiple component material system, with spring means in the drive linkage particularly suited for storing and dissipating any unused energy inputted to the plunger power device for maintaining substantially continuous dispensing pressures on the components for continuous mixing and flow through a common static mixing nozzle.

BRIEF DISCRIPTION OF THE DRAWINGS

These and further objects, advantages and features of the present invention will be understood and appreciated upon reviewing the following disclosure, including as a part thereof the accompanying drawings, in which.

Figure 1:
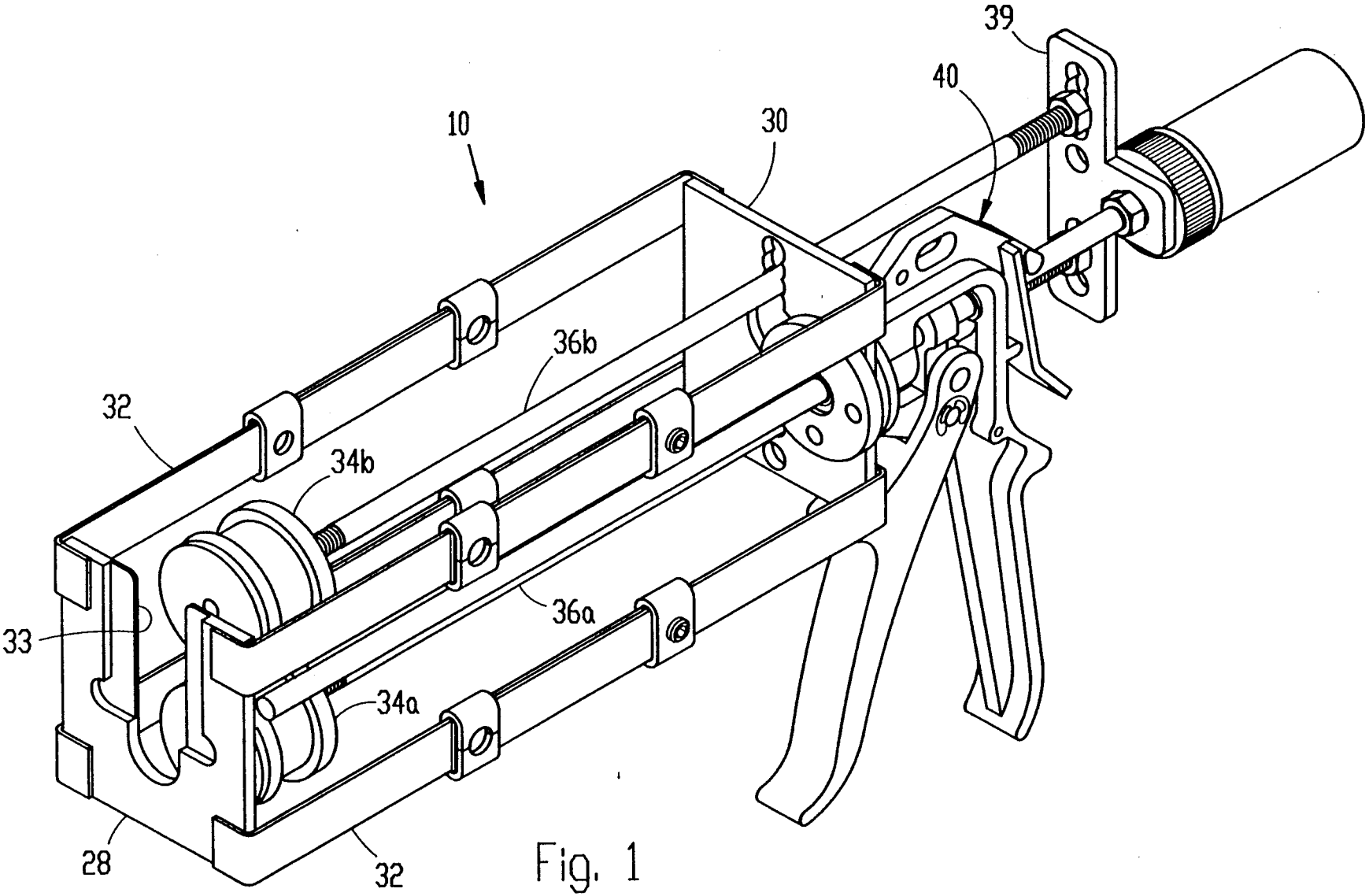
FIG. 1 is a perspective view of a first embodiment of dispensing tool, without material cartridges therein.
Figures 2, 3, 4, 5:
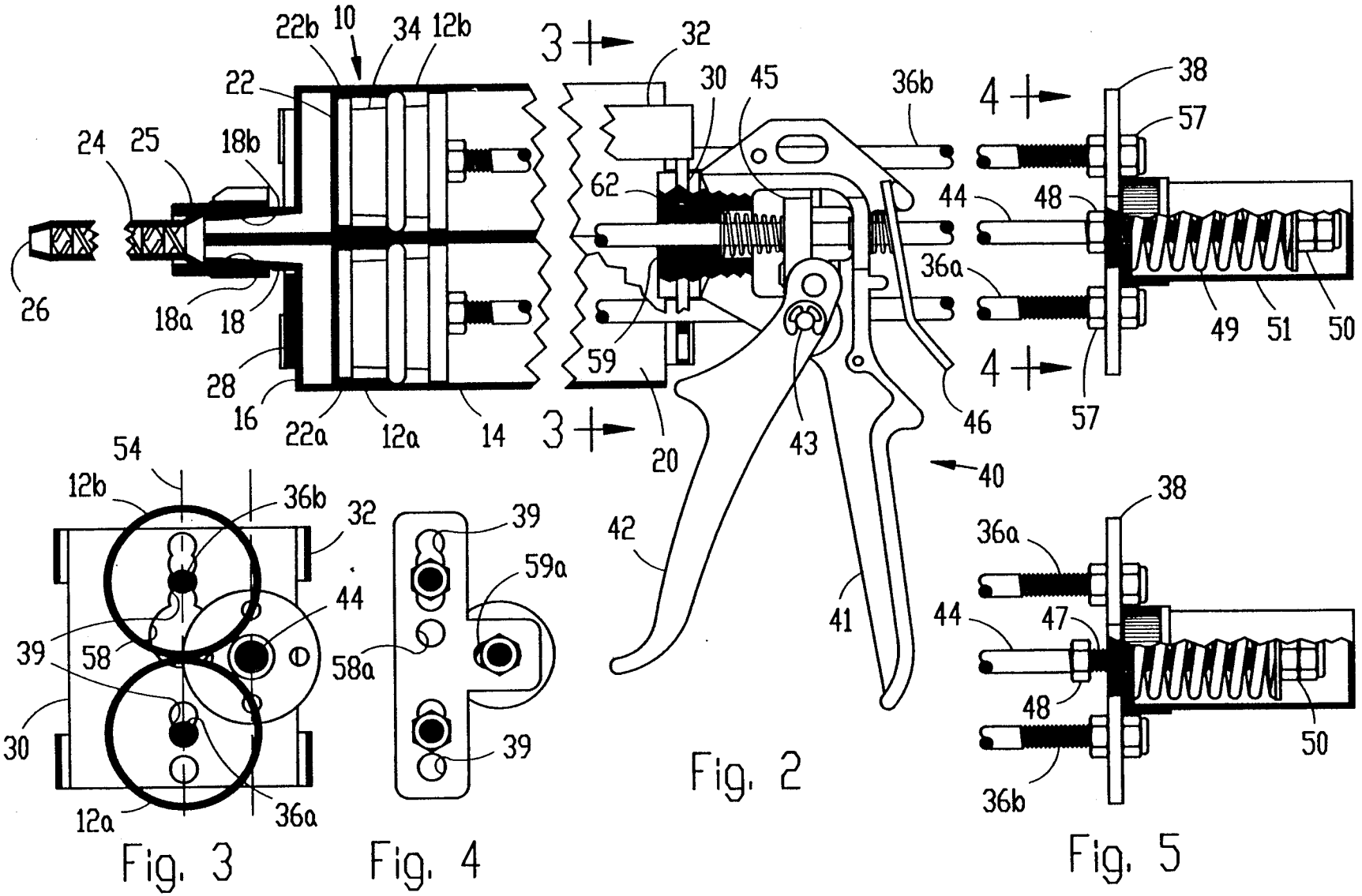
FIG. 2 is a side elevational view, partly broken away and in section for clarity of disclosure, of the tool of FIG. 1, except with a pair of material cartridges shown operatively in place therein.
Figure 7:
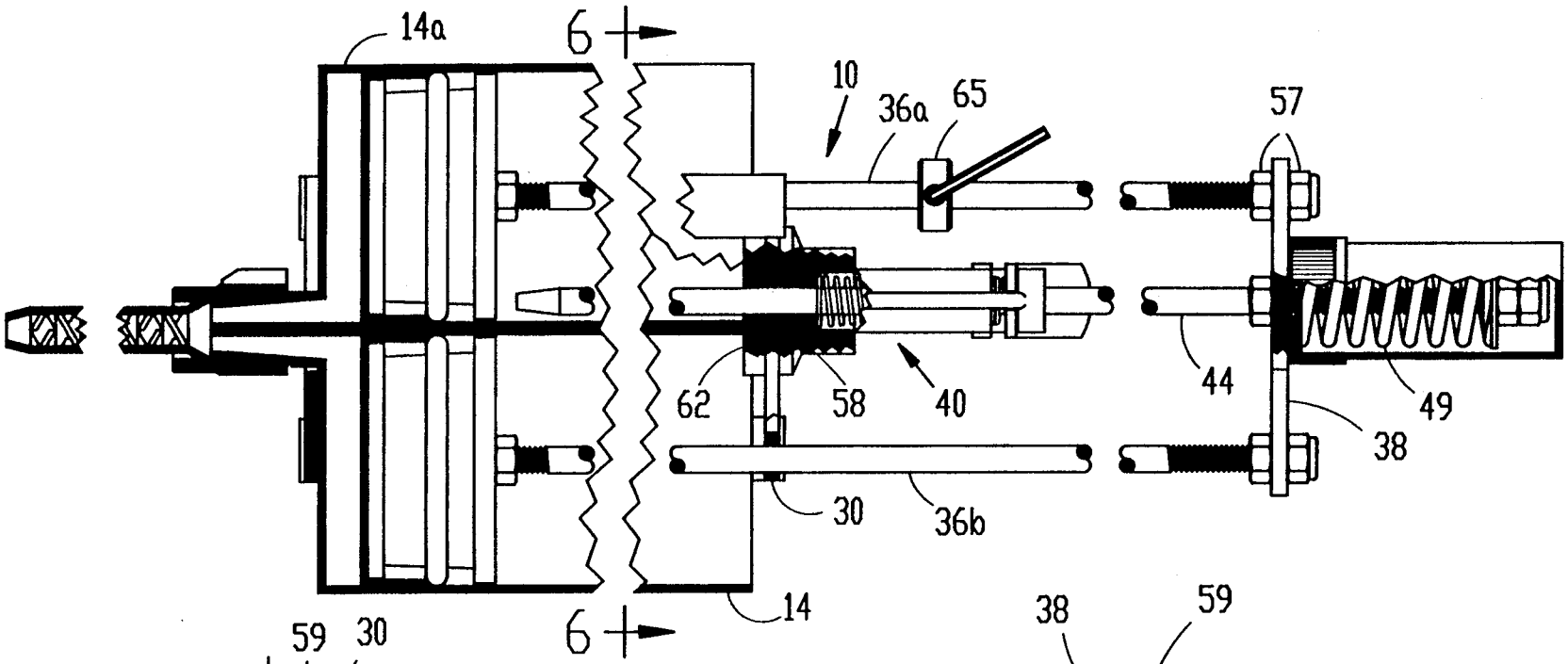
Figure 8:
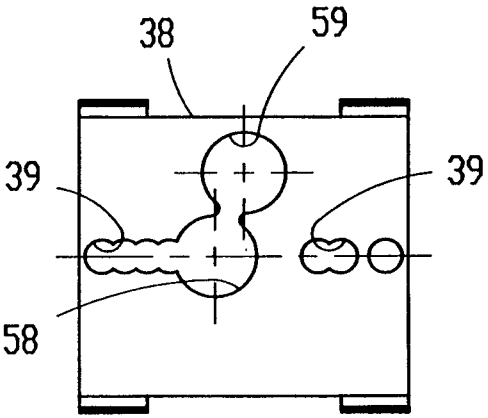
Figure 6:
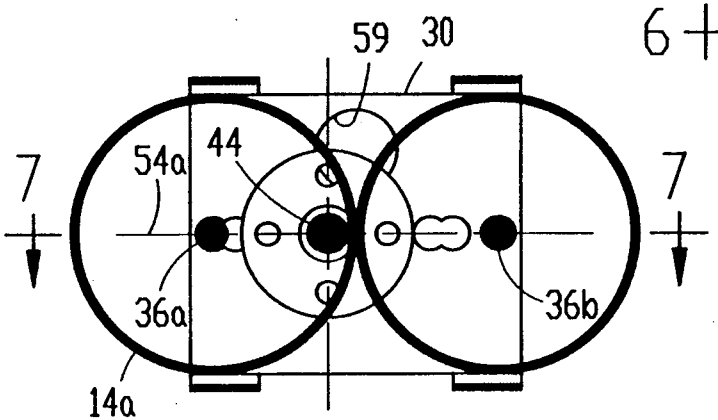
Figure 12:
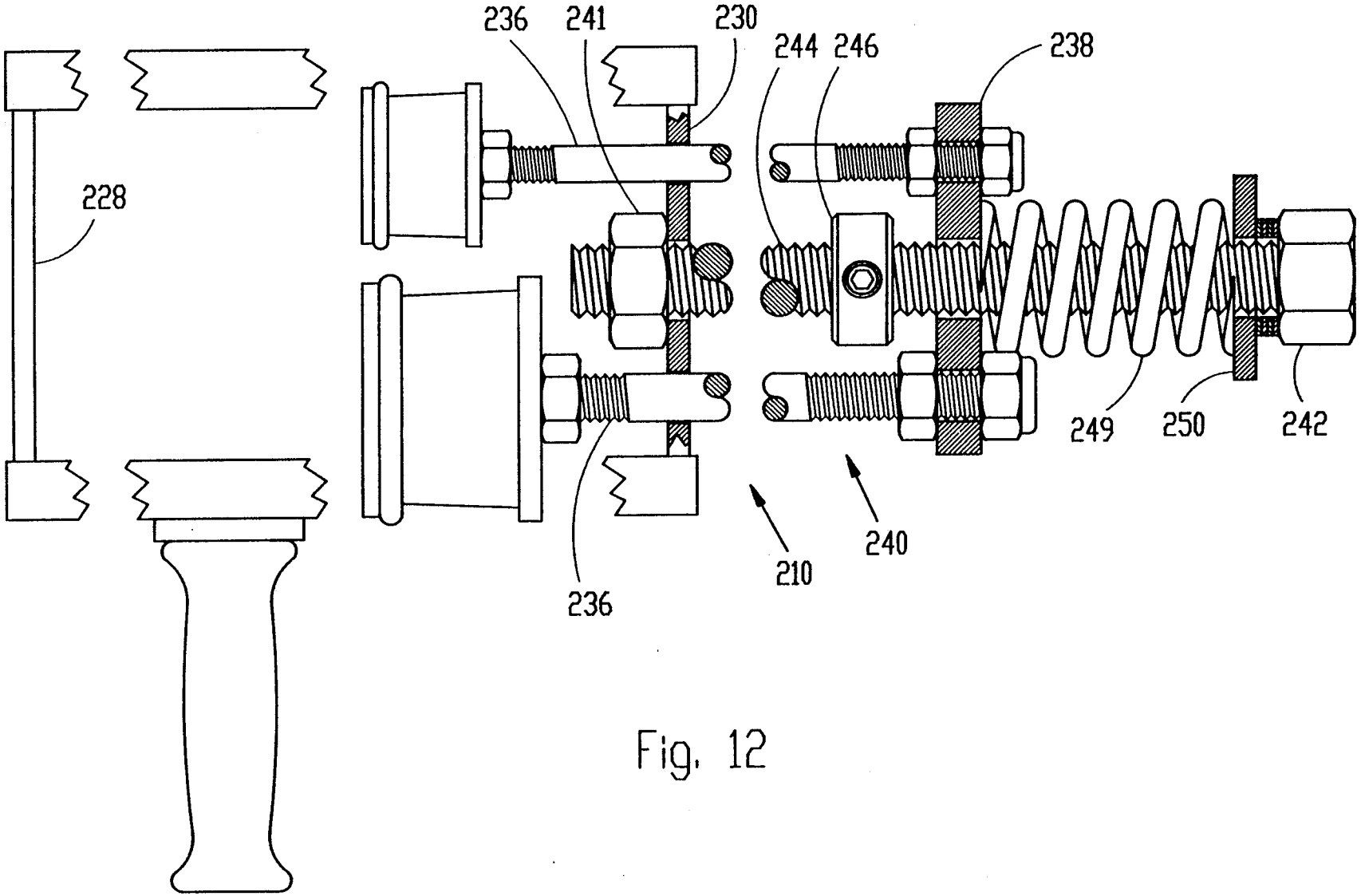

FIGS. 3 and 4 are fragmentary sectional views, taken generally along lines 3—3 and 4—4 respectively in FIG. 2;

FIG. 5 is a side elevational view similar to a portion of FIG. 2, except showing the compenents in an alternative operating position;

FIG. 6 is a fragmentary sectional view similar to FIG. 3, except taken generally along line 6—6 in FIG. 7 and showing the dispensing tool reassemblied to an alternate configuration to accomodate large material cartridges;

FIG. 7 is a fragmentary sectional view taken generally along line 7—7 in FIG. 6;

FIG. 8 is an elevational view of the dissamblied rear tool wall, showing cutouts for receiving the drive rod guide in its alternate positions;

FIG. 9 is a side elevational view, partly broken away and in section for clarity of disclosure, of a second embodiment of dispensing tool, with a pair of material cartridges also shown operatively in place therein;

FIGS. 10 and 11 are fragramentary sectional views as seen generally from lines 10—10 and 11—11 in FIG. 9; and FIG. 12 is a side elevational view, partly broken away and in section for clarity of disclosure, of yet a third embodiment of dispensing tool, without any material cartridge in place.

DETAILED DESCRIPTION OF ILLUSTRATED EMBODIMENTS

The dispensing tools 10, 110 and 210 to be disclosed herein are designed to hold two separate cartridges and to simultaneously power a plunger in each cartridge, to discharge the different cartridge materials proportionally as needed for a selected two-component material system. However, any of these tools could be used for dispensing material from a single cartridge, where just one of the tool plungers would then be used with the single cartridge. Also, the two-component tools illustrated can be modified for holding one, three or even four cartridges for specifically dispensing one, three or four component material systems.

In this disclosure, structures of the dispensing tools will be identified by numbers only, unless a distinction is to be made between like structures, where the identifying number will then also have a letter subscript.

The material cartridges **12*a*, 12*b* illustrated in FIGS. 2 and 3 are typical, having a tubular body wall 14 with a closure wall 16 and tubular nozzle 18*a*, 18*b* at one end and an open opposite end 20 closed by a wiper 22*a*, 22*b*** seated against the inside face of the body wall and axially slidable within the cartridge. The contained cartridge material is flowable, as a paste or liquid. In a single component material system, the cartridge would contain the intended final or end use material itself; while in a multiple component material system, each cartridge would contain a different component, and the components would have to be mixed together before being discharged as the intended final material.

In the illustrated two component system, two cartridges **12*a*, 12*b* are in parallel side-by-side relationship, being releasibly held together by cooperating pin and socket structures (not shown) in the respective cartridge walls. As so connected, the cartridge nozzles 18*a*, 18*b* have walls shaped as equi-sized threaded half-cylinders that line up adjacent one another to define a single threaded cylindrical exterior centered approximately along the contacting sides of the cartridges. A static mixing nozzle 24 is designed to be sealed over the cartridge nozzles, and a nut 25 cooperates with the threaded exterior walls to retain the static mixing nozzle in this sealed relation. The static mixing nozzle 24 has intertwined axially extended flow passages (not shown) that specifically separate and combine repeatedly, effective thereby to throughly mix the axially moving components before their combined discharge at outlet 26**.

Each wiper 22 serves as a piston that is displaced toward the closure wall 16 to pressurize and force the contained material out of the open nozzle 18. The cross-section and length of the nozzles 18, 24 and 26 (compared to the cross-section of each cartridge and wiper) and the viscosity of each contained material influence the resistance against material discharge, and the pressure buildup needed within the cartridge to provide material discharge must exceed this resistance and the actual discharge pressure.

The dispensing tool 10 has a cartridge holding frame with opposing restraining wall 28 and rear wall 30, and spaced axial members 32 connected rigidly between these walls. Plungers **34*a*, 34*b* are supported on elongated rods 36*a*, 36*b* extended through open guides 39 in the rear wall 30 and connected to common wall 38, operable to move in unison substantially between the restraining wall 28 and rear wall 30. When the cartridges are positioned in the frame, each closure wall 16 is against the restraining wall 28 and the nozzles 18 and 24 are fitted through a slotted opening 33 therein. Each plunger 34*a*, 34*b* is sized to fit within its cartridge open end 20 and against the wiper 22*a*, 22*b*** therein.

A power device 40 is mounted on the rear wall 30 suited to drive the plungers axially into the open end of its respective cartridge. The illustrated power device 40 is a conventional ratchet mechanism having a stationary frame and handle 41 and trigger 42 pivoted thereto on pin 43. An elongated drive rod 44 fits through the ratchet mechanism, extending generally parallel and between the plunger rods 36*a*, 36*b*. Drive member 45 and lock member 46 releasably engage the power device frame and drive rod 44 (such as being spring biased thereagainst), and the drive member 45 further is coupled to the trigger 42.

Squeezing the trigger 42 toward frame handle 41 axially shifts the drive member 45 in a forward direction toward the restraining wall 28 (leftwardly in FIG. 2), and the drive member carries the drive rod 44 with it. The lock member 46 in the illustrated position holds the drive rod 44 as forwardly shifted, even when the trigger 42 is released from its fully squeezed position close to frame handle 41 and returned to its illustrated position. Moving the lower free end of lock member 46 toward the frame handle 41 serves to release the drive rod 44, whereupon the drive rod can then be moved rearwardly away from the restraining wall 28. Each trigger squeeze thus indexes the drive rod 44 a limited power stroke, where it stays until being advanced further by again squeezing the trigger 42 or until being released by shifting the lock member 46.

The drive rod 44 extends loosely through connecting wall opening 47, and when a stop 48 secured on the drive rod is positioned against the wall 38, a maximum drive rod projection is defined rearwardly beyond the wall. Coil compression spring 49 is on this drive rod projection, trapped between the wall 38 and a stop 50 threaded on the drive rod 44. Cover 51 can enclose the spring.

The stop 50 will commonly be adjusted to strain spring 49 with a minimum static force, sufficient only to hold stop 48 snugged against the wall 38. The spring and maximum drive rod projection further are selected to provide an effective spring stroke (when strained between its minimum static force and bottomed conditions) and generated force sufficient to move the plungers (and wipers) forwardly within the cartridges 12 for discharging material from the cartridges under most intended operating conditions.

With the stop 48 against the connecting wall 38, a solid drive linkage is defined between the drive rod 44 and plunger rods 36, to provide that drive rod indexing toward the restraining wall 28 will simultaneously shift the plungers 34 forwardly equal amounts. This condition will continue only so long as the forward movement of drive rod 44 does not exceed the advancing rate of the resisting plungers, and the needed drive rod force does not exceed the minimum static spring force. When these conditions occur, even momentarily, the spring 49 will be strained and the stop 48 will be gapped away from the wall 38 (see FIG. 5).

With the stop 48 gapped away from the wall 38 and the spring dynamically strained, the drive linkage becomes resilient and the movements of the drive rod 44 and plunger 34 will no longer be simultaneous and in unison. Instead, axial plunger movement will be caused solely by the dynamically strained spring 49 balanced against the resisting force required for moving the plungers (and wipers) within the cartridges.

Repeated activation of the trigger 42 will continue to index the drive rod 44 forwardly toward restraining wall 28, but such displacement will be shared between actual plunger movement toward the restraining wall 28 and gap increase (or decrease) resulting in increased (or decreased) compression of the spring 49.

The spring 49 can be dynamically compressed only until it bottoms on itself, whereupon a solid drive linkage will once again be established between the drive rod and plungers. The dispensing tool 10 thereafter will function as a conventional tool, whereby attempted repeated activation of the trigger 42 would be possible only at the rate corresponding to the forward plunger advance. The maximum dynamic spring force occurs just before or as the spring bottoms on itself.

The spring 49 thus effectively couples the restraining wall 28, power device 40 and drive rod 44 relative to one another (via the positioned cartridge), and automatically compensates for differences between the drive rod and plunger displacements. The dynamically strained spring 49 stores displacement energy inputted to the power device energy, but unused when the plungers 34 cannot simultaneously advance toward the restraining wall 28 in unison with the indexing drive rod, and thereafter biases the plungers toward the restraining wall 28 with a continuous force varying in magnitude less than its maximum.

With the illustrated conventional compression spring 49, the dynamic spring force would vary linearly with spring displacement. Different type(s) of spring(s) could be used to have the dynamic spring force versus displacement vary in a nonlinear manner, progressively or stepped. Although the difference between the maximum and minimum spring forces might be large, any force changes due to slight changes of spring strain ocassioned during its operative stroke would be small. Of real importance is the fact that such spring force would be continuous, even during the pauses between trigger squeezes. The continuously driven plungers provide more uniform and continuous material discharge, for improved continunity of material discharge. This is particularly effective and needed in mixing the separate components of a multiple component material system.

The disclosed spring linkage also makes the dispensing tool easier and more effective to use. For example, each trigger squeeze will be resisted by only the known dynamic spring force, and can be completed quickly. By contrast, each trigger squeeze of a solid drive linkage dispensing tool can only be completed as rapidly as the corresponding advance of the plungers occurs in providing the related material discharge, with the further uncertainity of the needed squeezing pressures and duration.

The tool 10 assemblied as in FIGS. 2–4 has the drive rod 44 offset from a plane (indicated as line 54 in FIG. 3) extended through the plunger rods 36, and the frame handle 41 and trigger 42 are elongated in a direction generally parallel to this plane. With the frame handle 41 and trigger 42 normally gripped during tool use and aligned in a somewhat vertical orientation, the cartridges are stacked vertically only one deep sideways in front of the user. Virtually all users believed this orientation made the tool seem lighter in weight and easier to grip and manipulate. However, as the operating drive rod is under tension and the plunger rods are under compression, an offset couple exists between the drive and plunger rods causing structural deformation as the loads are increased.

FIGS. 6–8 illustrate the dispensing tool 10 in an alternate mode of assembly, particularly suited for use with large cartridges, which generally will require larger rod forces for discharging the contained materials through the mixing nozzle and against the outlet pressures than are required for smaller cartridges. Large cartridges could be needed and used to achieve large volume material capacities or specific component ratios.

In the FIGS. 6–8 assembly, drive rod 44 is aligned on the plane (indicated as line 54*a* in FIG. 6) extended through the plunger rods 34, to eliminate the offset couple generated between offset drive and plunger rods. The elongated frame handle 41 and trigger 42 lie generally perpendicular to the defined plunger rod plane 54. The drive rod 44 is off center between the plunger rods, being closer to plunger rod 34*a* to allow the drive rod to telescope into the open cartridge end adjacent the cartridge wall 14*a*. The off center drive and plunger rods can create a small couple between the components. However, by locating the cartridge holding the more viscous material over the drive rod, the dissimilar plunger rod forces needed for discharging the respective materials will tend to compensate for the off center couple. When dissimilar size cartridges are used, it likewise could be preferred to position the larger cartridge over the drive rod.

The ratchet device 40 illustrated herein is of conventional design, having the frame and previously mentioned components mounted to move therein including trigger 42, drive rod 44, drive block 45 and lock lever 46. The ratchet device frame is removably secured to the tool frame rear wall 30 by nut 62 having a flange and a smaller threaded stem projecting therefrom. The nut stem fits from the cartridge side of the rear wall 30 through either of two openings 58 and 59 in the rear wall, and is threaded into the ratchet device frame located on the other side of the wall. To provide for the disclosed alternate modes of assembly, the rear wall openings 58 and 59 are centered to correspond to the above mentioned intended drive rod positions. The nut has a centered throughbore for then receiving and supporting the drive rod.

To allow assembly modifications of the tool, the plunger rods 36 are releasably secured relative to the connecting wall 38 by nuts 57. Moreover, the open guides 39 in the rear and connecting walls 30 and 38 are aligned at appropriate spacings from the rear wall openings 58 and 59 (and 58*a* and 59*a*) to allow the drive and plunger rods to be repositioned to accommodate the different size cartridges needed for the different components and their varied ratios.

A second embodiment of a dispensing tool 110 is illustrated in FIGS. 9 and 10. This dispensing tool has a frame formed by opposing front and rear walls 118 and 130 connected together by axial members 132, and a restraining wall 128 mounted to slide along axial members 132. A linking rod 143 is threaded into the restraining wall 128 and is fitted loosely through an opening in the front wall 118, and its head 150 serves as a stop adjustably determining the maximum separation of these walls. A coil compression spring 149 is located on this linking rod 143, trapped between the walls 118 and 128, and biases these walls apart.

Power ratchet device 140 is mounted on the rear wall 130 and has a trigger 142 that when squeezed axially moves drive rod 144 in a forward direction toward the restraining wall 128. The drive rod 144 projects forwardly of the ratchet device 140 through wall 130 and is connected directly to plunger 134*b*, and also projects rearwardly of the ratchet device and is connected via wall 138 to elongated plunger rod 136*a* and plunger 134*a*. Each plunger 136 is sized to fit within the open end of its cartridge 112*a*, 112*b* and against the wiper 122*a*, 122*b* therein, operable to be moved axially of the cartridge.

In operating the dispensing tool 110, when the static spring force maintains the stop 150 snugged against the front wall 118, the walls 118 and 128 are fully spaced apart and the axially shifted drive rod 144 and connecting wall 138 will shift the plungers 134*a* and 134*b* in unison and in equal amounts forwardly toward the restraining wall 128. However, when the static spring force is exceeded, forward movement of drive rod 144 will dynamically strain the spring 149 by the differential axial displacement between the drive rod 144 and the plungers 134. Once the stop 150 is gapped from the front wall 118, plunger movement will be caused solely by the dynamically strained spring 149, balanced against the resistance of moving the plungers relative to the cartridges and independently of the drive rod movement.

In the dispensing tool 110, the spring 149 is coupled between the power device 140 and the restraining wall 128, via the front wall 118 and the linking rod 143.

Yet another dispensing tool 210 is illustrated in FIG. 12, having a power device 240 in the form of a screw mechanism instead of a ratchet mechanism. Specifically, the drive rod 244 is threaded and has a threaded connection at 241 with rear frame wall 230, and extends freely through an opening in plunger rod connecting wall 238. Plunger rods 236 extend slidably through the rear wall 230, and are connected to the wall 238. A stop 246 is secured to the drive rod 244 and upon engagement with wall 238 sets the maximum projection of the drive rod beyond the wall 238. Coil compression spring 249 is trapped between the wall 238 and thrust stop 250 on the drive rod 244. A socket nut 242 is keyed to the drive rod 244 at its end. The separation of frame walls 228 and 230, and the plunger and drive rod strokes allow material cartridges (not shown) to be fitted in the frame and the plungers to be moved axially in the cartridges and against the wipers. A handle 241 projects off of the elongated frame members 232.

The dispensing tool 210 is operated by rotating the drive shaft 244, as by a tool (not shown) keyed to socket nut 242. When the static compression force of spring 249 maintains the stop 246 snugged against wall 238, the axially shifted drive shaft 244 will shift the wall 238 and connected plungers 234 in unison and in equal amounts forwardly toward the restraining wall 228. However, when plunger movement cannot keep up with the advancing drive rod 244, drive rod movement will dynamically strain the spring 249 by the differential displacement between drive rod and plunger movements. Once the stop 246 is gapped from the wall 238, plunger movement will be caused solely by the dynamically strained spring 249, balanced against the forces needed for moving the plungers relative to the cartridges.

Another feature this invention provides, suited for use with each disclosed embodiment, is lock means that can be applied to the dispensing tool to preclude or control plunger movement within the cartridge. Generally the lock means illustrated (see FIGS. 7, 9 and 11) each has an annular body fitted loosely on the plunger or drive rod, and having a set screw that can be tightened down against the rod to fix the position of the lock along the rod.

In FIG. 7, the lock 65 is on the plunger rod 36*a*. When the lock 65 is tightened while against the rear tool wall, trigger activation can compress the spring to the degree desired while forward plunger movement within the cartridge is precluded. However, upon the lock 65 being released, the stored spring energy can dispense the contained material from the cartridge. This allows the spring to be dynamically strained when the tool is in one location, and to use the stored spring energy to discharge material from the tool when desired, including possibly only after the tool has been repositioned to another location. When the lock 65 is tightened while being spaced from the tool frame, trigger activation can move the plunger only until the lock 65 hits and is stopped by the frame, suited to measure plunger movement automatically within the cartridge for metering material discharge from the cartridge.

In FIGS. 9 and 11, the lock 165 is on the combined drive-plunger rod 144, and is not symmetrical. Instead, approximately one-half of the lock body extends radially from the rod sufficiently to butt against the tool frame (as illustrated) upon trigger activation, while approximately the opposite half of the lock body extends a lesser radial distance so that the lock repositioned 180 degrees on the rod will clear the tool frame and instead butt against the lock lever 146. When the lock 165 butts against the frame as illustrated, continued forward drive rod movement will be precluded as the trigger can no longer be activated, but forward plunger movement might thereafter continue depending on the strain condition of the spring 149. When the lock butts against the lock lever 146, the drive rod and plunger rods will be disengaged to depressurize the cartridge.

The locks 65 and 165 can be locked in nonuse positions immediately next to the plunger rod connecting wall, and/or could be used together on any of the dispensing tools.

While only specific embodiments of the invention have been illustrated, it is apparent that variations may be made therefrom without departing from the inventive concept. Accordingly, the invention is to be limited only by the scope of the following claims.

What is claimed as our invention is:

1. A dispensing tool for a multiple component material system, comprising the combination of separate cartridges disposed in parallel side-by-side relationship, each cartridge holding a component and having a tubular body with a closure wall and nozzle at one end and an open opposite end closed by a wiper slidable within the tubular body, and a static mixing nozzle sealed over the cartridge nozzles and having a common outlet for the mixed components;

restraining and rear walls spaced apart to receive the cartridges therebetween with each closure wall against the restraining wall, a plunger sized to fit within the open end of each cartridge and against the wiper, elongated rods projecting forwardly and rearwardly beyond the rear wall for supporting each plunger for movement between the restraining and rear walls, and a connecting member between the plunger rods allowing them to move only in unison;

a power ratchet mechanism having a frame secured to the rear wall and having a stationary handle and a movable trigger connected to the frame, an elongated drive rod fitted through the ratchet mechanism and operatively coupled to the trigger, and the manual actuation of the trigger operatively indexing said drive rod specific displacements in the direction of the restraining wall;

linkage means including spring means operatively connecting the elongated drive rod and restraining wall together operable for allowing plunger movement relative to the restraining wall independently of the output movement of the elongated drive rod, and spaced stops in the linkage means operable for limiting the amount of available independent movement; and the spring means, when being subjected to static force conditions, bottoming the linkage means as a solid limit against one of the stops, operable to provide in-unison indexing of said plungers specific incremental displacements in the direction forwardly toward the restraining wall consistent with the actuation of the power ratchet mechanism; and the spring means, when being subjected to dynamic force conditions in the event of and to compensate for a differential between lessor actual plunger displacements and the expected plunger displacements consistent with in-unison indexing upon the actuation of the power ratchet mechanism, gapping the one stop and biasing the plungers resiliently and continuously in the forward direction toward the restraining wall, up to subjecting the spring means to maximum dynamic force conditions and thereupon bottoming the linkage means as another solid limit against the other of the stops; and the dynamic force conditions of the spring means being sufficient to move the plungers forwardly within the cartridges for discharging the contained components from the static mixing nozzle outlet.

2. A multiple component dispensing tool according to claim 1, further including said spring means including an elongated guide member extended between said spaced stops and freely moved relative to only a first of the stops, a spring member positioned on the guide member and operatively trapped between the stops, and either of said stops being common relative to either said restraining wall or said connecting member while the other of said stops is independent of said restraining wall or said connecting member.

3. A multiple component dispensing tool according to claim 1, further including said spring means including said drive rod extended freely through and rearwardly beyond said connecting member and a first of said stops being fixed on said drive rod spaced rearwardly of the connecting member, and a spring member positioned on the drive rod and snuggly trapped between the connecting member and first stop.

4. A multiple component dispensing tool according to claim 1, further including the drive rod being offset from a plane extended through the plunger rod means, and the frame handle and trigger being elongated in a direction generally parallel to this plane, to provide that as normally gripped during tool use the frame handle and trigger will be aligned vertically and the cartridges are stacked vertically.

5. A multiple component dispensing tool according to claim 1, further including the drive rod and frame handle and trigger being operable in either of two orientations relative to the plunger rods, namely in a first orientation suited for smaller cartridges with smaller plunger rod separations and rod forces, with the drive rod being offset from a plane extended through the plunger rods and otherwise generally centered between the plunger rods and with the frame handle and trigger being elongated in a direction generally parallel to this plane, to provide that as normally gripped during tool use the frame handle and trigger will be aligned vertically and the cartridges will be stacked vertically; and in a second orientation suited for larger cartridges with larger plunger rod separations and rod forces, with the drive rod being aligned on the plane extended through the plunger rods, the drive rod being off center slightly between the plunger rods, and the elongated frame handle and trigger lying generally perpendicular to the defined plunger rod plane, to provide elimination of most of the offset couples generated between the plunger and drive rods; and means removably securing the ratchet mechanism to the rear wall in alternative positions to yield the above mentioned first and second orientations.

6. A multiple component dispensing tool according to claim 1, further including a front wall forwardly spaced for the restraining wall and said spring means including an elongated guide member extended freely through and forwardly beyond said front wall and having a stop fixed thereon spaced forwardly thereof, and a spring member positioned on the guide member and trapped between the front wall and stop.

7. A multiple component dispensing tool according to claim 1, further including the drive rod being aligned on the plane extended through the plunger rods to provide elimination of most of the offset couples generated between the plunger and drive rods, and the elongated frame handle and trigger lying generally perpendicular to the defined plunger rod plane, the drive rod being slightly off center between the plunger rods to have the drive rod telescope into the open cartridge end adjacent the cartridge wall.

8. A multiple component dispensing tool according to claim 7, further including said spring means including said drive rod extended freely through and rearwardly beyond said connecting member and a first of said stops being fixed on said drive rod spaced rearwardly of the connecting member, and a spring member positioned on the drive rod and snuggly trapped between the connecting member and first stop.

9. A tool for dispensing material from a cartridge having a tubular body with a closure wall and nozzle at one end and an open opposite end closed by a wiper slidable within the tubular body, comprising the combination of restraining and rear walls spaced apart to receive the cartridge therebetween with the closure wall against the restraining wall, a plunger sized to fit within the open end of the cartridge and against the wiper, and elongated rod means projecting forwardly and rearwardly beyond the rear wall for supporting the plunger for movement between the restraining and rear walls;

power means secured relative to the rear wall and having means to manually actuate the power means and means movable incrementally responsive thereto, and linkage means including spring means and the elongated rod means connecting the movable means of the power means and restraining wall together operable for allowing plunger movement relative to the restraining wall independently of the drive output movement of the movable means of the power means, and spaced stops in the linkage means operable for limiting the amount of available independent movement; and the spring means, when being subjected to static force conditions, bottoming the linkage means as a solid limit against one of the stops, operable to provide in-unison indexing of said plunger specific incremental displacements in the direction forwardly toward the restraining wall consistent with the actuation of the power means, and the spring means, when being subjected to dynamic force conditions in the event of and to compensate for a differential between a lesser actual plunger displacement and the expected plunger displacement consistent with in-unison indexing upon the actuation of the power means, gapping the one stop and biasing the plunger resiliently and continuously in the forward direction toward the restraining wall, up to subjecting the spring means to maximum dynamic force conditions and thereupon bottoming the linkage means as another solid limit against the other of the stops; and the dynamic force conditions of the spring means being sufficient to move the plunger forwardly within the cartridge for discharging the material from the nozzle.

10. A multiple component dispensing tool according to claim 9, further including said spring means including an elongated guide member extended between said spaced stops and freely moved relative to only a first of the stops, a spring member positioned on the guide member and snuggly trapped between the stops, and either of said stops being common relative to said restraining wall while the other of said stops is independent of said restraining wall.

11. A dispensing tool according to claim 9, further wherein said elongated rod means is connected directly to said plunger and wherein said means connecting the power means and plunger together includes said elongated rod means being actuated directly by said power means.

12. A dispensing tool according to claim 9, further including releasably lock means on the rod means, operable when properly located and secured tightly on the rod means to preclude plunger movement within the cartridge for thereby causing displacement differential strain of the spring means upon the actuation of the power means and operable when thereafter released for causing spring means bias on the plunger consistent with the displacement differential strain.

13. A dispensing tool according to claim 9, further wherein said first mentioned elongated rod means is connected directly to said plunger, and wherein said means connecting the power means and plunger together includes a second elongated rod means extended parallel to said first elongated rod means and actuated directly by said power means, and a member connecting the elongated rod means of the power means and plunger together to allow rod means movement only in unison.

14. A tool for dispensing material from a cartridge having a tubular body with a closure wall and nozzle at one end and an open opposite end closed by a wiper slidable within the tubular body, comprising the combination of restraining and rear walls spaced apart to receive the cartridge therebetween with the closure wall against the restraining wall, a plunger sized to fit within the open end of the cartridge and against the wiper, and elongated rod means projecting forwardly and rearwardly beyond the rear wall for supporting the plunger for movement between the restraining and rear walls;

power means secured to the rear wall and having means to manually actuate the power means and means movable incrementally responsive thereto, and means including the elongated rod means connecting the movable means of the power means and plunger together operable normally for axially indexing said plunger specific incremental displacements in the direction forwardly toward the restraining wall consistent with the actuation of the power means; and spring means effectively coupled between the power means and restraining wall, said spring means including a transverse member having an opening and an elongated rod fitting freely through said opening to a projection beyond the member, a coil compression spring located on this rod projection, and spaced stop means secured on the rod on opposite sides of the member with one of said stop means being adjacent the spring operable to trap said spring against said member and with the other of said stop means being remote from the spring and adjacent said member, whereby the other stop means becomes gapped from the member in the event of and to compensate for any differential between the actual plunger displacement and the expected plunger displacement consistent with in-unison indexing upon the actuation of the power means, and the spring thereupon becomes differentially strained consistent with the differential displacement and operates to bias the rod relative to the member and the plunger in the forward direction toward the restraining wall and to maintain the forward bias on the plunger continuous consistent with the differential strain.

15. A dispensing tool according to claim 14, further wherein said first mentioned elongated rod means is connected directly to said plunger, and wherein said means connecting the power means and plunger together includes said elongated rod extended parallel to said first elongated rod means and actuated directly by said power means, means including said transverse member for connecting the elongated rod of the power means and rod means of the plunger together to allow movement thereof only in unison and said transverse member also serving as the one stop means secured on the rod, whereby said spring serves with the other stop means gapped from the transverse member to bias the plunger relative to and toward the restraining wall.

16. A dispensing tool according to claim 14, further including a front wall secured to the rear wall with the restraining wall being positioned between the front and rear walls, said front and transverse walls being one and the same and the restraining wall serving as the one stop means secured on the rod, whereby said spring serves with the other stop means gapped from the front wall to bias the plunger relative to and toward the restraining wall.

17. A dispensing tool according to claim 14, further including said power means being a ratchet mechanism having an actuating trigger, operable upon activation to axially index said elongated power means rod means relative to and toward the restraining wall.

18. A dispensing tool according to claim 14, further including said power means being a screw operable upon activation to axially index said elongated rod means relative to and toward the restraining wall.

19. A dispensing tool for a multiple component material system, comprising the combination of separate cartridges disposed in parallel side-by-side relationship, each cartridge holding a component and having a tubular body with a closure wall and nozzle at one end and an open opposite end closed by a wiper slidable within the tubular body, and a static mixing nozzle sealed over the cartridge nozzles and having a common outlet for the mixed components;

restraining and rear walls spaced apart to receive the cartridges therebetween with each closure wall against the restraining wall, a plunger sized to fit within the open end of each cartridge and against the wiper, elongated rods projecting forwardly and rearwardly beyond the rear wall for supporting each plunger for movement between the restraining and rear walls, and a connecting member between the plunger rods allowing them to move only in unison;

a power ratchet mechanism having a frame secured to the rear wall and having a stationary handle and a movable trigger connected to the frame, an elongated drive rod fitted through the ratchet mechanism and operatively coupled to the trigger, and the manual actuation of the trigger operatively and incrementally indexing said drive rod specific displacements in the forward direction toward the restraining wall;

spring means effectively coupled between the drive rod and restraining wall operable to be strained in the event of and to compensate for any differential between the actual plunger displacements and the expected plunger displacements consistent with in-unison indexing upon the actuation of the power ratchet mechanism, and said spring means being operable to maintain a continuous bias on the plungers in the forward direction toward the restraining wall consistent with the displacement differential and having an effective stroke and generated force sufficient to move the plungers forwardly within the cartridges for discharging material from the static mixing nozzle outlet;

the drive rod and frame handle and trigger being operable in either of two orientations relative to the plunger rods, namely in a first orientation suited for smaller cartridges with smaller plunger rod separations and rod forces, with the drive rod being offset from a plane extended through the plunger rods and otherwise generally centered between the plunger rods and with the frame handle and trigger being elongated in a direction generally parallel to this plane, to provide that as normally gripped during tool use the frame handle and trigger will be aligned vertically and the cartridges will be stacked vertically; and in a second orientation suited for larger cartridges with larger plunger rod separations and rod forces, with the drive rod being aligned on the plane extended through the plunger rods, the drive rod being off center slightly between the plunger rods, and the elongated frame handle and trigger lying generally perpendicular to the defined plunger rod plane, to provide elimination of most of the offset couples generated between the plunger and drive rods; and the ratchet mechanism being removably secured to the rear wall by a nut having a flange and a smaller stem projecting therefrom, the nut stem fitting from the cartridge side of the rear wall through either of two openings in the rear wall and being connected to the ratchet mechanism frame located on the other side of the rear wall, the nut having a centered throughbore for receiving and supporting the drive rod, and the rear wall openings being located to provide for the nut to fit alternatively therein and yield the above mentioned first and second orientations.

20. A multiple component dispensing tool according to claim 19, further including said spring means including an elongated guide member extended between spaced stops and freely moved relative to only one of the stops, a spring member positioned on the guide member and snuggly trapped between the stops, and either of said stops being common with either of said restraining wall and said connecting member while the other of said stops is independent of said restraining wall and said connecting member.

21. A dispensing tool for a multiple component material system, comprising the combination of separate cartridges disposed in parallel side-by-side relationship, each cartridge holding a component and having a tubular body with a closure wall and nozzle at one end and an open opposite end closed by a wiper slidable within the tubular body, and a static mixing nozzle sealed over the cartridge nozzles and having a common outlet for the mixed components;

restraining and rear walls spaced apart to receive the cartridges therebetween with each closure wall against the restraining wall, a plunger sized to fit within the open end of each cartridge and against the wiper, elongated rods projecting forwardly and rearwardly beyond the rear wall for supporting each plunger for movement between the restraining and rear walls, and a connecting member between the plunger rods allowing them to move only in unison;

a power ratchet mechanism having a frame secured to the rear wall and having a stationary handle and a movable trigger connected to the frame, an elongated drive rod fitted through the ratchet mechanism and operatively coupled to the trigger, and the manual actuation of the trigger operatively and incrementally indexing said drive rod specific displacements in the forward direction toward the restraining wall;

spring means effectively coupled between the drive rod and restraining wall operable to be strained in the event of and to compensate for any differential between the actual plunger displacements and the expected plunger displacements consistent with in-unison indexing upon the actuation of the power ratchet mechanism; and said spring means including an elongated guide member extended between spaced stops and freely moved relative to only one of the stops, a spring member positioned on the guide member and snuggly trapped between the stops, and either of said stops being common with either of said restraining wall and said connecting member while the other of said stops is independent of said restraining wall and said connecting member, and said spring means being operable to maintain a continuous bias on the plungers in the forward direction toward the restraining wall consistent with the displacement differential and having an effective stroke and generated force sufficient to move the plungers forwardly within the cartridges for discharging material from the static mixing nozzle outlet.

* * * * *